US006346664B1

(12) United States Patent
Shuen

(10) Patent No.: US 6,346,664 B1
(45) Date of Patent: Feb. 12, 2002

(54) KNOCKDOWN HAND BELL

(75) Inventor: Shun-Tian Shuen, Taipei (TW)

(73) Assignee: Janchy Enterprise Co., Ltd., Taipei (TW)

( * ) Notice: Subject to any disclaimer, the term of this patent is extended or adjusted under 35 U.S.C. 154(b) by 0 days.

(21) Appl. No.: 09/717,202

(22) Filed: Nov. 22, 2000

(51) Int. Cl.[7] ..... G10D 13/08

(52) U.S. Cl. ..... 84/402; 84/404; 84/406; 84/408; 446/419

(58) Field of Search ..... 84/402, 404, 406, 84/408, 103; 446/437, 418, 419, 485; 273/457; 473/571

(56) References Cited

U.S. PATENT DOCUMENTS 530,116 A * 12/1894 Murphy ..... 473/571
1,589,075 A * 6/1926 Hasenstein ..... 446/192
2,484,159 A * 10/1949 Flynn, Jr. ..... 446/422

* cited by examiner

*Primary Examiner*—Shih-Yung Hsieh
(74) *Attorney, Agent, or Firm*—Bacon & Thomas, PLLC

(57) ABSTRACT

Knockdown hand bell including two casings, a ram body and a hook member. The ram body serves to hit the casings and create a sound. The hook member serves to hook the ram body. The casings have multiple patterns and are replaceably mated with each other to form various types of hand bells to achieve a decorative effect.

1 Claim, 4 Drawing Sheets

3
1

3
1

3
1

3
1

3
1

3
1

3
1

3
1

KNOCKDOWN HAND BELL

BACKGROUND OF THE INVENTION

The present invention relates to a knockdown hand bell which can be hung in a car or on a pet as a decorative article. The casings of the hand bell are replaceable as desired to form various types of hand bells.

There are various kings of car-used decorative articles which are commercially available. For example, hand bells are often hung in a car to achieve a decorative effect. However, the existent hand bells have some shortcomings as follows:

1. The conventional hand bell is made as an integral body. When a user desires to replace the hand bell, it is necessary to buy another one. This is not economical.

2. The conventional hand bells have substantially identical appearance without novelty.

3. The conventional hand bell is composed of two casings and a ham body. When assembled, the ham body is first placed into the casings and then the casings are adhered to each other.

Such procedure is time-consuming and laborious.

SUMMARY OF THE INVENTION

It is therefore a primary object of the present invention to provide a knockdown hand bell which can be hung in a car or on a pet as a decorative article. The casings of the hand bell have different patterns and can be replaced as desired to form various appearances of hand bells.

It is a further object of the present invention to provide the above knockdown hand bell which is freely replaceably assembled to vary the appearance so that the money for buying another hand bell is saved.

It is still a further object of the present invention to provide the above knockdown hand bell the components of which can be DIY assembled.

The present invention can be best understood through the following description and accompanying drawings wherein:

DETAILED DESCRIPTION OF THE PREFERRED EMBODIMENT

Figure 1:
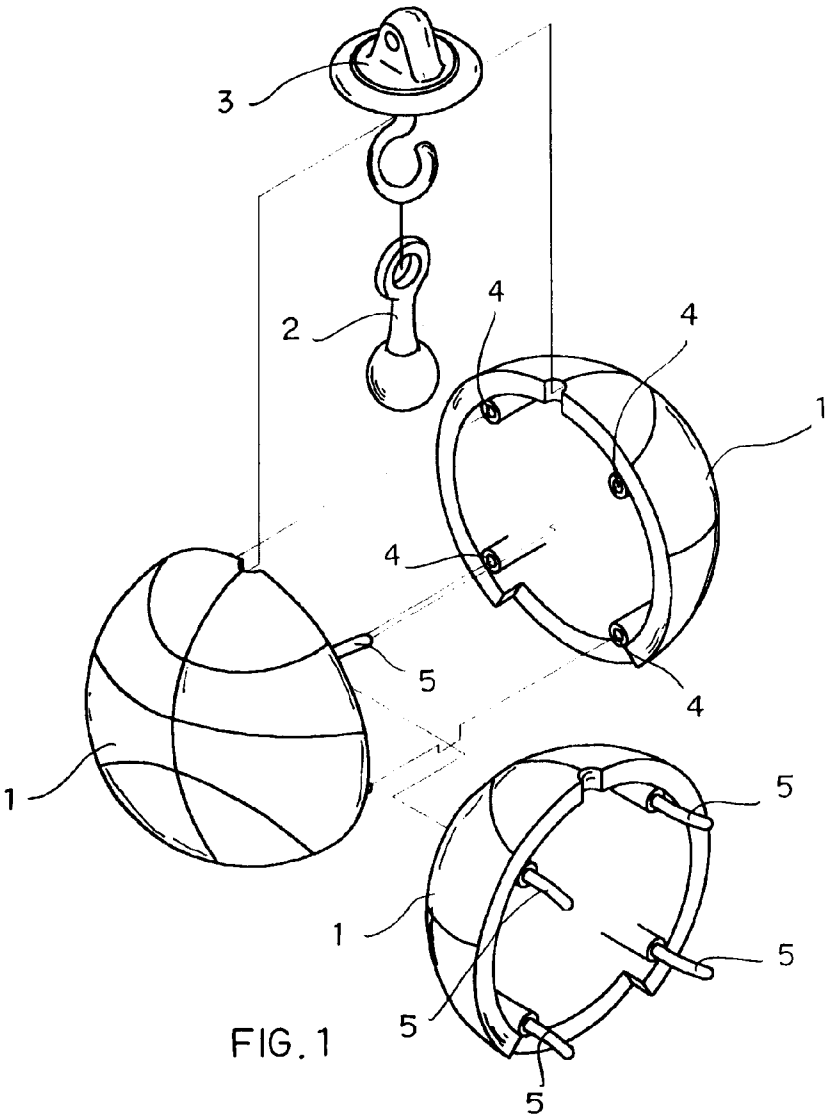
FIG. 1 is a perspective exploded view of the knockdown hand bell of the present invention.
Figure 2:
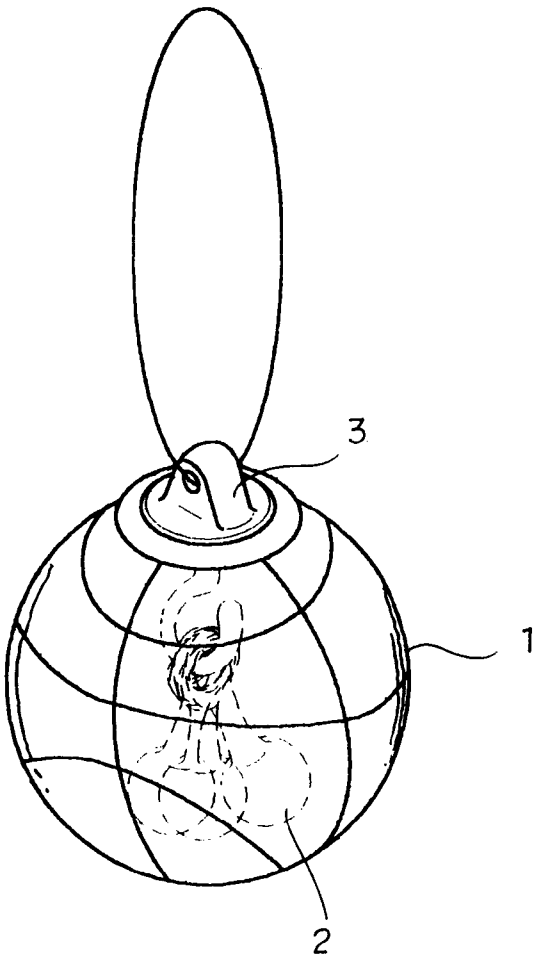
FIG. 2 is a perspective assembled view of the knockdown hand bell of the present invention.

Please refer to FIGS. 1 and 2. The knockdown hand bell of the present invention includes two casings 1, a ram body 2 and a hook member 3.

One of the casings 1 is formed with insertion holes 4, while the other of the casings 1 is formed with insertion posts 5.

The ram body 2 is a conventional one which serves to hit the casings 1 and create a sound.

The hook member 3 is also a conventional one for hooking the ram body 2.

Figures 3A, 3B, 3C, 3D, 3E, 3F, 3G, 3H:
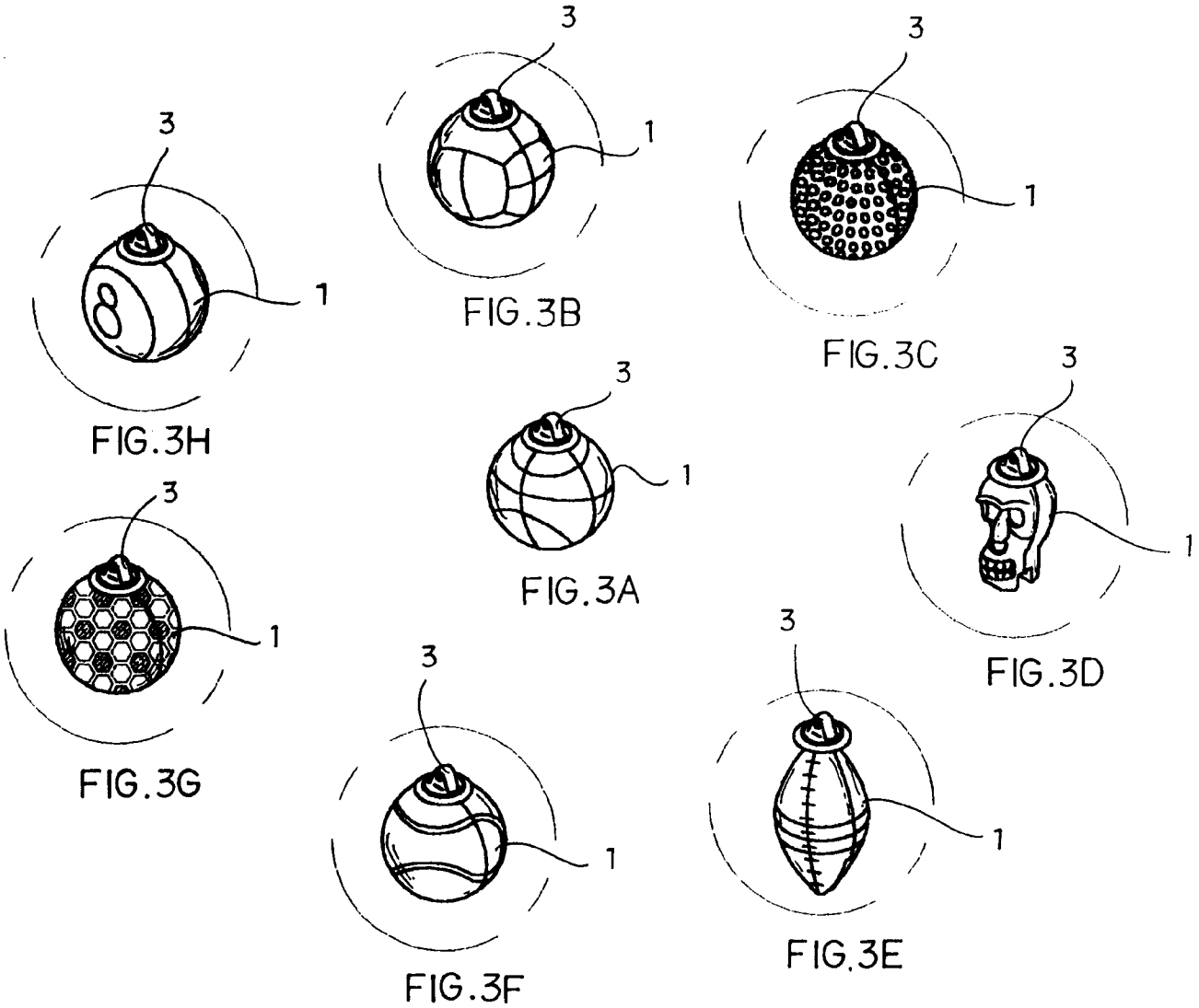
FIG. 3A FIG. 3B FIG. 3C FIG. 3D FIG. 3E FIG. 3F FIG. 3G FIG. 3H shows various types of knockdown hand bells of the present invention.

Please refer to FIG. 3. There are many embodiments of the casings 1 which can be replaced with each other as desired.

Figure 4:
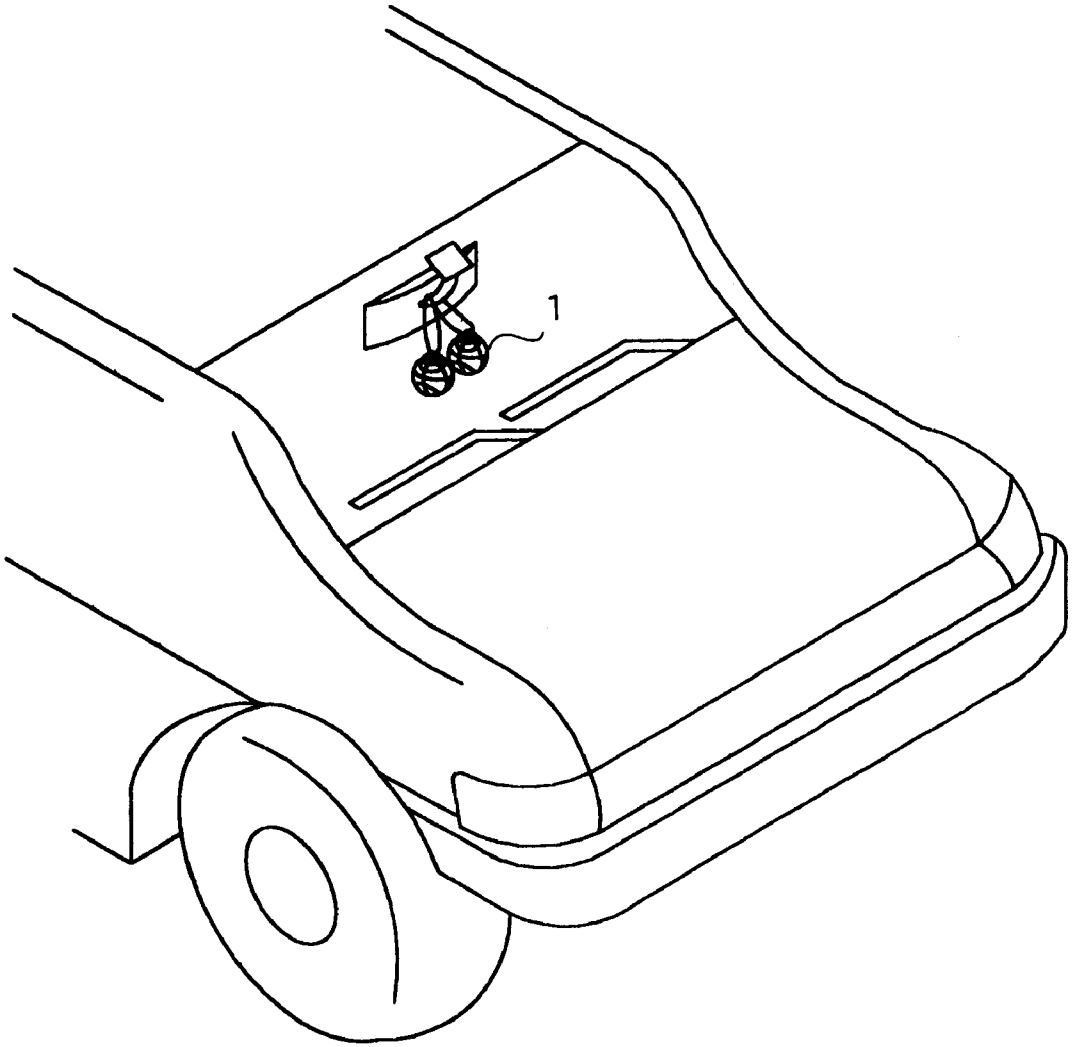
FIG. 4 shows that the knockdown hand bells of the present invention is hung in a car.

Referring to FIG. 4, the present invention can be hung on a rearview mirror in a car. Alternatively, the present invention can be hung on a pet as a decorative article.

When assembled, the ram body 2 is first hooked on the hook member 3. Then the casings 1 are mated with each other with the insertion posts 5 inserted into the insertion holes 4. Accordingly, the casings 1 can be firmly associated with each other.

The above embodiments are only used to illustrate the present invention, not intended to limit the scope thereof. Many modifications of the above embodiments can be made without departing from the spirit of the present invention.

What is claimed is:

1. A hand bell comprising a first casing provided with a plurality of insertion posts, a second casing provided with a plurality of corresponding insertion holes, the insertion posts being detachably engagable within the insertion holes to form the bell, a ram body for striking the casings to create a sound, a hook member for supporting the bell from a support, and the casings being provided with mating patterns thereon, whereby plural casings having different patterns may be interchangeably assembled for forming bells having different decorative affects.

* * * * *